United States Patent [19]

Green

[11] Patent Number: 4,477,029

[45] Date of Patent: Oct. 16, 1984

[54] SHREDDING MACHINE

[75] Inventor: Douglas F. Green, Brisbane, Australia

[73] Assignee: Rover-Scott Bonnar Limited, Brisbane, Australia

[21] Appl. No.: 377,845

[22] Filed: May 13, 1982

[30] Foreign Application Priority Data

May 15, 1981 [AU] Australia ..... PE8895

[51] Int. Cl.[3] ..... B02C 18/18

[52] U.S. Cl. ..... 241/101.7; 241/152 R; 241/282.2

[58] Field of Search ..... 241/101 D, 101.6, 101.7, 241/152 A, 152 R, 92, 282.1, 282.2, 292.1

[56] References Cited

U.S. PATENT DOCUMENTS 4,360,166 11/1982 Biersack ..... 241/101.7 X

*Primary Examiner*—Mark Rosenbaum

*Attorney, Agent, or Firm*—Mahoney & Schick

[57] ABSTRACT

The shredding machine includes a housing with a lower shredding chamber located in the upper part of the housing. An upwardly extending trunk is mounted on the housing. A hopper is mounted on the free end of the trunk and the lower portion of the trunk constitutes an upper shredding chamber commencing with the lower shredding chamber. An electric motor supported in the housing has its output shaft projecting into the flower shredding chamber. Upper and lower cutting means are mounted on the shaft, the upper cutting means rotates in the upper shredding chamber and the lower shredding means rotates in the lower shredding chamber. A feed duct extends through the trunk and the upper shredding chamber. It terminates just above the lower shredding chamber. The upper cutting means shreds material fed to the machine through the hopper and the lower shredding means shreds material fed to the machine through the feed duct.

3 Claims, 4 Drawing Figures

SHREDDING MACHINE

The present invention relates to a shredding machine which converts bulk material such as long grass, straw, garden cuttings, prunings and other refuse material of various types to relatively small particles which can be readily packed into containers for transport to a refuse repository or in the case of garden refuse the shredded material can be used on gardens as mulch or composted. Various types of shredding machines to achieve this object has been produced in the past. Such machines have normally included an internal combustion engine as the power source, they have been constructed of heavy materials and are relatively expensive.

The object of the present invention is to produce a relatively light-weight shredding machine which will not only shred flexible material such as long grass, straw, paper and the like but which will also shred relatively rigid material such as branches, and the like. To this end the shredder of the invention includes dual cutting means, one of which is designed to shred the flexible material whilst the other is designed to shred relatively rigid material.

The machine has in-built safe guards which prevent oversized material from being fed into the machine and it is an important feature of the invention that the shredder includes separate feed means for the relatively rigid material which not only prevents oversized material being fed into the machine but also guides and holds that material whilst it has been shredded, a further feature of the invention resides in the provision of a particular type of dual cutting means which is efficient in operation, robust, and easy to service.

The invention in its broadest form resides in a shredding machine comprising a housing with a lower shredding chamber located in the upper part of said housing, the lower chamber being provided with a discharge port communicating with a discharge duct from the housing; an upwardly extending truck mounted on the housing, the lower portion of which forms an upper shredding chamber communicating with the lower shredding chamber, a feed hopper located on the free end of said trunk and having a restricted inlet to the truck spaced from the upper shredding chamber; power means supported in the housing with the output shaft thereof extending into the lower shredding chamber; upper and lower cutting means fixed to the output shaft, the upper cutting means being adapted for rotation in the upper shredding chamber and the lower cutting means being adapted for rotation in the lower shredding chamber, a feed duct in said trunk and extending through the said upper shredding chamber and terminating above the lower shredding chamber, that portion of the feed duct in the shredding chamber constituting a shear plate which co-operates with the upper cutting means to reduce material fed to said upper shredding chamber.

The invention will be more readily understood from the detailed description of a preferred embodiment in which.

Figure 1:
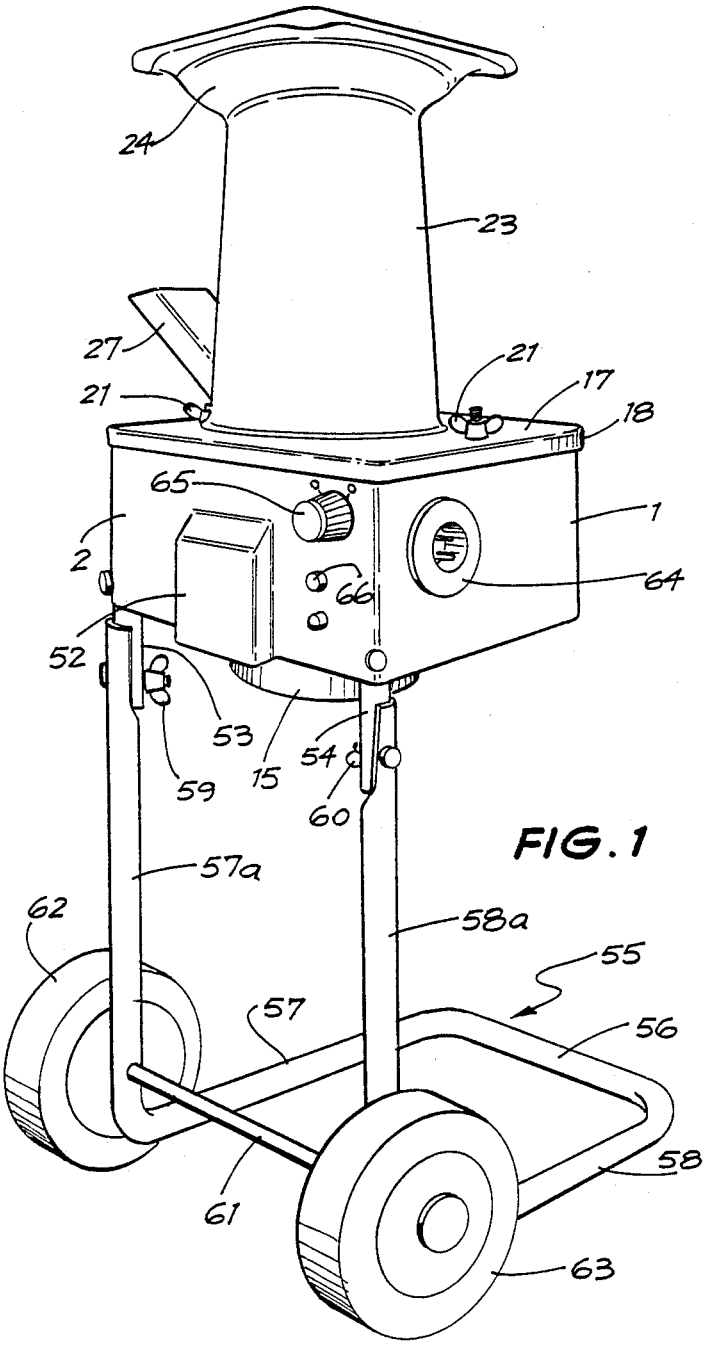
FIG. 1 is a perspective view illustrating salient features of the shredder.

The shredder includes a housing formed of side walls 1, 2, 3 and 4; the walls 3 and 4 being joined by a curved portion 5. The walls 1 and 2 are connected by an internal wall 6 which is spaced from the wall 4 to form a discharge duct designated generally by reference 7.

Figure 2:
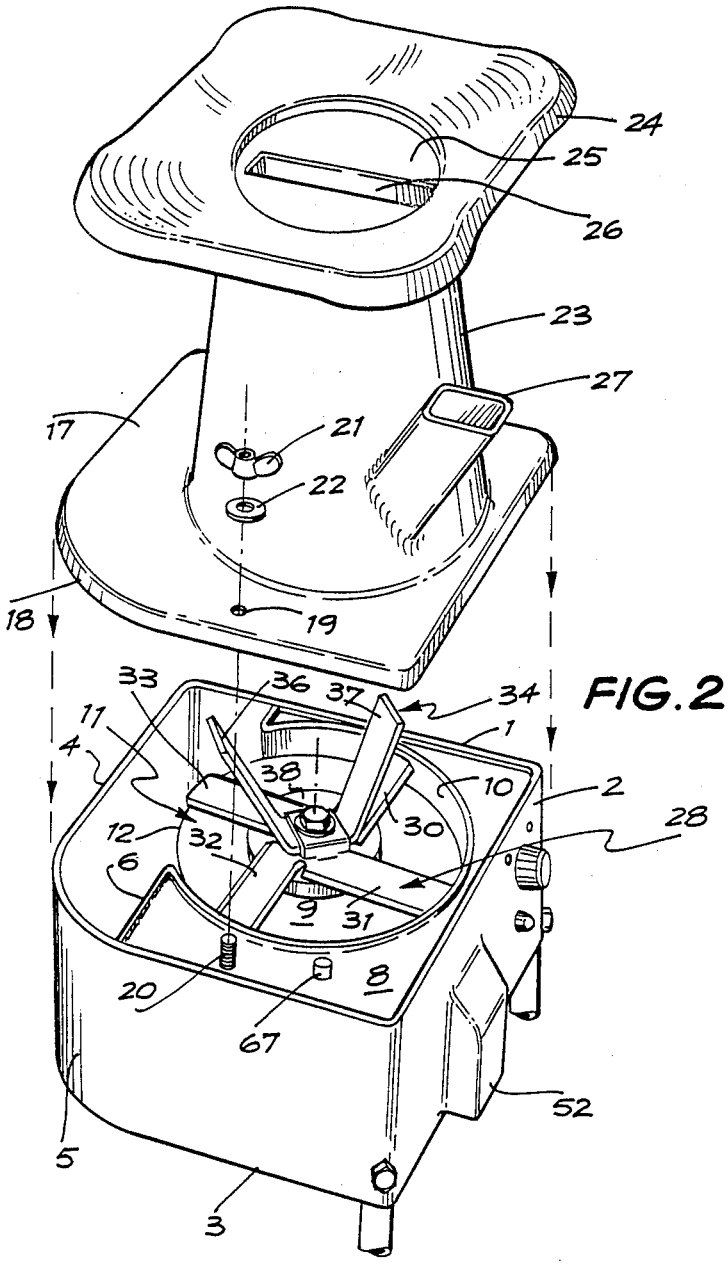
FIG. 2 is an exploded view of the shredder housing illustrating details of the cutting means.

The top of the housing is formed by a plate 8, which is fixed as indicated to the walls 1, 2, 3 and 6. The plate is provided with a circular recess thereby forming the bottom 9, and the side wall 10 of the lower shredding chamber designated generally by reference 11 (FIG. 2).

The lower shredding chamber is so located in the plate 8, that its side wall intersects the plane of the wall 6 thereby providing an opening or port in the wall of the lower shredding chamber which communicates with the discharge duct 7. An arcuate shaped extension 12 of the bottom 9 completes the bottom of the lower shredding chamber.

Figure 3:
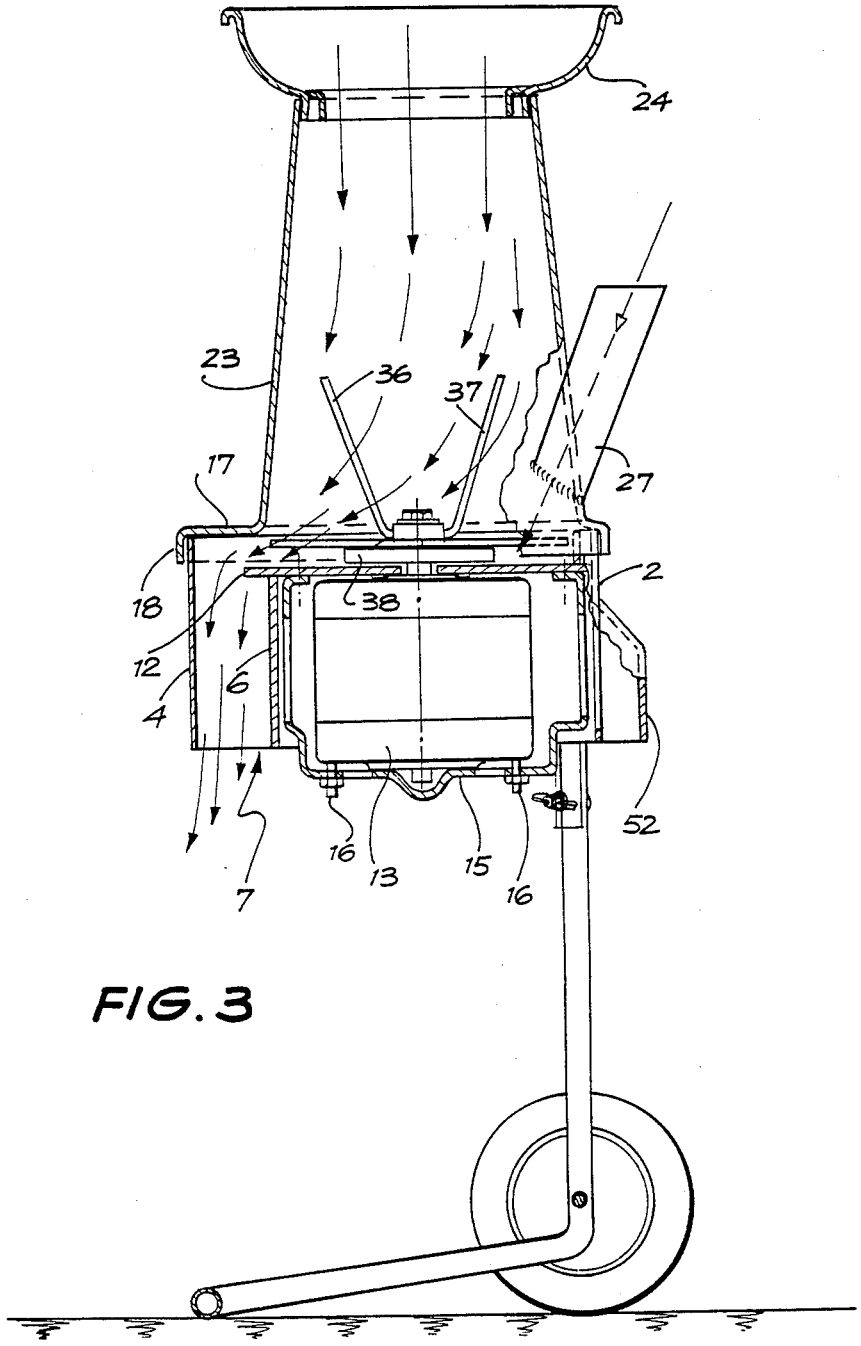
FIG. 3 is a side view of FIG. 1.
Figure 4:
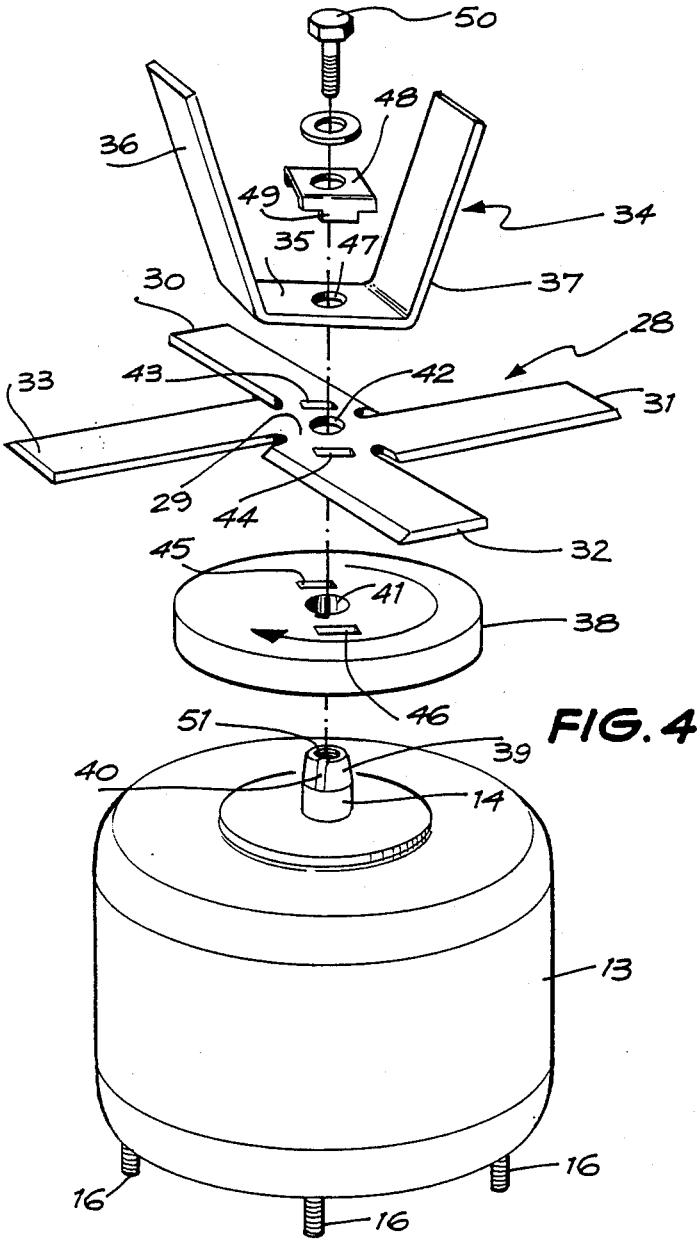
FIG. 4 is an exploded view showing the manner of fixing the upper and lower cutting means to the power means.

Power means in the form of an electric motor 13 (FIG. 3) is vertically supported in the housing below the lower shredding chamber with its output shaft 14, projecting through a bore in the bottom 9, on which the upper and lower cutting means to be described hereafter are mounted. The motor is enclosed by a cover or cowl 15, in order to prevent dust and other particles from penetrating the motor casing. The cowl being secured to the motor or body by bolts 16.

The top of the housing is closed by a cover plate 17 having a downturned, peripheral flange 18. The plate is provided with holes 19, through which studs 20 fixed in the plate 8, project whereby the cover plate is removably secured into position by suitable securing means such as wing nuts 21 and washers 22.

The cover plate is provided with an opening which is substantially concentric with the circular recess in the plate 8 when the cover plate is secured in position.

Mounted on the cover plate above the mentioned opening is a truncated cone shaped trunk 23, the lower portion of which forms the upper shredding chamber. The trunk is provided with a hopper 24 at its free end which communicates with the interior thereof. The exit from the hopper is substantially closed by a plate 25 having a transverse slot 26 therethrough which provides for communication between the hopper and the interior of the trunk 23. The restricted outlet from the hopper serves two purposes, firstly it prevents material which is larger than the machine is designed to shred from being fed into the upper shredding chamber, and secondly, it prevents the user from accidentally bringing his fingers into contact with the blades rotating therein when the machine is in operation.

The trunk 23 is provided with an inlet duct 27 to the lower shredding chamber. This duct is formed of a rectangular section tube which projects through the opening in the trunk and terminates below the upper cutting means and just above the lower cutting means. The tube passes through the trunk at an acute angle and is located at a tangent to the axis of rotation of the upper cutting means.

Mounted on the drive shaft is the upper and lower cutting means. The lower cutting means is designated generally by the reference 28. In the embodiment being described the lower cutting means is formed of a steel plate having a body portion 29 with four arms constituting cutting blades 30, 31, 32 and 33 the leading edge of each blade is sharpened, and the ends of the respective blades are shaped so they can freely rotate in the lower shredding chamber.

The upper cutting means is designated generally by the reference 34 and is formed on a substantially "U" shaped member having a bight portion 35 and upstanding limbs 36 and 37, the leading edges of which are sharpened. The spacing between limbs 36 and 37 is such that the upper cutting means can freely rotate in the upper shredding chamber clear of that portion of the duct 27 in the upper shredding chamber. It will be appreciated that the mentioned portion of the duct constitutes a shear plate which co-operates with the upper cutting means whereby this means can shred material fed to the upper shredding chamber.

The lower cutting means is supported on a disc 38 secured to the motor output shaft 14. To this end the end of the output shaft is cone shaped as indicated at 39 it is provided with a keyway 40 and the shaft is inserted in a bore 41 in the disc and fixed against independent rotation by a key (not shown).

The lower cutting means is provided with a bore 42 which is adapted to communicate with the bore 41. Two diametrically opposed slots 43, 44 in the lower cutting means communicate with two diametrically opposed slots 45, 46 in the disc 38.

The upper cutting means is located by its bight portion 35 on the lower cutting means. The bight has a centrally disposed bore 47 therein which communicates with the bore 42. A saddle member 48 provided with downwardly depending tongues 49 is positioned over the bight portion with the tongues passing through the slots 43 and 44 and engaging in the slots 45 and 46. A bolt 50 passes through the bore 47 and 42 and engaged in the screwed bore 51 in the motor output shaft thereby securing the respective cutting means to the motor output shaft.

The side wall 2 has a portion domed outwardly as at 52 to facilitate cooling of the motor.

Two posts 53 and 54 are secured in the housing as illustrated in FIG. 1 whereby a wheeled stand designated generally by reference 55 may be detachably secured thereto. The stand is formed in one piece of tubular metal and has a bight portion 56 connecting two transversely dispersed limbs 57 and 58. These limbs are bent upwardly to form vertical extensions **57*a* and 58*a*, the free ends of which are detachably secured to the posts 53 and 54 by wing nuts 59 and 60. The extensions 57*a* and 58*a* are connected by an axle 61 on which wheels 62 and 63** are rotatably mounted.

The housing is provided with a socket connection 64 whereby an electric motor is connected to the power supply. An on-off switch 65 is provided to actuate the motor and a reset button 66 is provided to re-engage the throw-out switch (not shown) which is incorporated in the circuit connecting the electric motor with the socket connection 64 and which automatically opens such circuit in the event of overload.

It will be appreciated that the cover plate 17 can be simply removed from the housing by removing the wing nuts 21 and washers 22. Normally it would still be possible to actuate the motor with the machine in this condition which of course would create an extremely hazardous condition. In order to prevent this happening a second on-off switch is included in the circuit connecting the motor to a power supply. This switch has an actuating button 67 which projects through an opening in the plate 8. When the plate 17 is in its normal closed position the switch is closed and so the motor can be operated however when the plate 17 is removed the switch automatically opens and it is impossible to energise the motor whilst the machine is in the disassembled condition.

In those cases where it is desired to shred flexible material, this material is fed through the hopper 24 and is comminuted by the upper shredding means, the shred material is ejected through the discharge duct 7.

In the case where it is desired to shred rigid material such as branches or other types of rigid material, this material is fed to the lower cutting means through the duct 27 to the lower shredding chamber. The size of the duct is such that it restricts the size of the material which can be fed into the machine to that which the machine is designed to handle. The duct correctly locates and holds the material in the correct designed position so as to enable it to be shred by the lower cutting means. The shred particles are then discharged from the machine through the mentioned discharge duct.

It will be appreciated that a receptacle may be conveniently detachably secured to the housing to collect material falling from the discharge duct.

I claim:

1. A shredding machine comprising a housing with a lower shredding chamber located in an upper part of said housing, the lower chamber being provided with a discharge port communicating with a discharge duct from the housing; an upwardly extending trunk mounted on the housing and having a free end and a lower portion spaced below said free end, the lower portion of said trunk forming an upper shredding chamber communicating with the lower shredding chamber, a feed hopper located on the free end of said trunk and having a restricted inlet to the trunk spaced from the upper shredding chamber; power means supported in the housing with an output shaft thereof extending into the lower shredding chamber and having a bore in the end thereof; upper and lower cutting means fixed to the output shaft, the upper cutting means being adapted for rotation in the upper shredding chamber and the lower cutting means being adapted for rotation in the lower shredding chamber, a disc having a centrally disposed bore there-through, means fixing said disc to the output shaft of the motor with said output shaft passing through said bore in said disc, said disc having spaced diametrically opposed slots therein, said lower cutting means comprising a body portion with four arms extending therefrom and constituting cutting blades, the body portion having a centrally disposed bore there-through with diametrically opposed slots positioned on opposite sides of said bore, said bore and said slots in said body portion being adapted to register with said bore and said slots, respectively, in said disc, the upper cutting means comprising a substantially U-shaped member having a bight portion with limbs of said U-shaped member upstanding therefrom and diverging from each other, a bore in the bight portion adapted to register with the bore in said body portion; a saddle clamp having a central portion positioned across the bight portion and tongues, which extend transverse to said central portion and pass through the slots in the body portion and engage in the slots in the disc, said central portion having a bore there-through adapted to register with said bore in said bight portion, and a bolt engaged in said bore in the end of the output shaft so that there can be no relative rotation between the upper and lower cutting means and the disc secured to said output shaft; a feed duct in said trunk and extending through said upper shredding chamber and terminating above the lower shredding chamber, that portion of the feed duct in the shredding chamber constituting a shear plate which cooperates with the upper cutting means to reduce material fed to said upper shredding chamber, said lower shredding material fed through said feed duct.

2. The shredding machine as claimed in claim 1 wherein the power means comprises an electric motor.

3. The shredding machine as claimed in claim 1 wherein the housing is supported on a detachable wheeled stand.

* * * * *